US008317569B2

(12) United States Patent
Fisher-Pacheco

(10) Patent No.: US 8,317,569 B2
(45) Date of Patent: Nov. 27, 2012

(54) MULTI-END ADJUSTABLE FASTENER STRAPS FOR BRA

(76) Inventor: Kelly Fisher-Pacheco, Anaheim Hills, CA (US)

( * ) Notice: Subject to any disclaimer, the term of this patent is extended or adjusted under 35 U.S.C. 154(b) by 343 days.

(21) Appl. No.: 12/769,468

(22) Filed: Apr. 28, 2010

(65) Prior Publication Data

US 2011/0269375 A1 Nov. 3, 2011

(51) Int. Cl.
*A41C 3/00* (2006.01)

(52) U.S. Cl. ..... 450/79; 450/58

(58) Field of Classification Search ..... 450/9, 10, 450/15–17, 26, 28, 71, 79, 72, 73, 54–58, 450/37, 36, 86; 2/96, 102, 105, 106, 108, 2/113–115

See application file for complete search history.

(56) References Cited

U.S. PATENT DOCUMENTS 2,662,522 A * 12/1953 Muller ..... 602/61
2,800,902 A * 7/1957 Wiltrout ..... 450/58
4,917,651 A * 4/1990 Rainville ..... 450/58
5,032,104 A * 7/1991 Rainville ..... 450/58
5,304,215 A * 4/1994 MacWhinnie et al. ..... 607/108
5,441,534 A * 8/1995 MacWinnie et al. ..... 607/108
5,776,177 A * 7/1998 MacWhinnie et al. ..... 607/108
5,807,160 A * 9/1998 Wehmeyer ..... 450/57
6,095,894 A * 8/2000 Stevens ..... 450/57
6,102,772 A * 8/2000 Fernandez ..... 450/1
RE36,869 E * 9/2000 Ewen ..... 450/1
6,237,599 B1 * 5/2001 Maulding ..... 128/845
6,241,715 B1 * 6/2001 Houser et al. ..... 604/385.07
6,319,091 B1 * 11/2001 Kilbride et al. ..... 450/17
6,464,717 B1 * 10/2002 Smith et al. ..... 607/108
6,755,717 B2 * 6/2004 Smith ..... 450/1
6,769,955 B1 * 8/2004 Fisher ..... 450/54
6,935,921 B1 * 8/2005 Eudenbach et al. ..... 450/54
7,001,240 B1 * 2/2006 Huffman-Jimenez ..... 450/58
7,128,635 B1 * 10/2006 Liu ..... 450/39
7,144,295 B2 * 12/2006 Fisher ..... 450/54
7,192,409 B2 * 3/2007 Lorenzo ..... 602/19
7,309,275 B1 * 12/2007 Morales ..... 450/38
7,445,541 B2 * 11/2008 Patterson ..... 450/54
2006/0003669 A1 * 1/2006 Li ..... 450/58

* cited by examiner

*Primary Examiner* — Gloria Hale
(74) *Attorney, Agent, or Firm* — David G. Duckworth; Russo & Duckworth, LLP

(57) ABSTRACT

A wide chest band extends horizontally outward from each cup of a bra. The connecting end of each of the single chest bands splits into multiple connecting fingers to adjustably connect with mating multiple connecting fingers extending from the connecting end of the other single breast band. Each of the pairs of mating fingers has adjustable connectors so that each of the pairs of mating fingers is adjusted independently to allow the bra to attach firmly and comfortably around a tapered torso of a wearer taking into account the varying girth at different heights on the tapered body.

7 Claims, 5 Drawing Sheets

MULTI-END ADJUSTABLE FASTENER STRAPS FOR BRA

CROSS-REFERENCE TO RELATED APPLICATIONS

The present utility patent applicant incorporates by reference in its entirety the specification of U.S. Pat. No. 6,769,955 issued to the present inventor on Aug. 3, 2004.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to brassiere fasteners and particularly to multiple vertically spaced end strap connectors extending from the end a single wide elasticized chest band extending laterally outward from each cup portion on a bra, each wide chest band being divided into multiple connector fingers at the end furthest from the cup creating at least two smaller vertically separated horizontal connector fingers having separate adjustable connectors on each mating pair of connecting fingers so that each of the pairs of mating fingers is adjusted independently to allow the bra to attach firmly and comfortably around a tapered torso of a wearer taking into account the varying girth at different heights on the tapered body of the wearer.

2. Description of Related Art Including Information Disclosed Under 37 CFR 1.97 and 1.98

The torso of a wearer may taper in various ways. Some peoples' torsos taper from a larger upper chest and rib cage portion of the torso tapering downwardly to a progressively narrower stomach portion and thin waist. Other peoples' torsos taper from a larger stomach portion to a narrower upper chest portion, such as on a pregnant woman. With weight gains and losses, the taper may change over time for the same person. Providing a tight comfortable fit with full support for the breasts, particularly large breasts, requires horizontal adjustability, which may vary depending of the vertical position of the connecting straps of a bra.

Prior art devices fail to provide the same firm support because they lack the adjustability with multiple independent connector straps with rows of connectors at different heights so that the prior art does not adjust securely to all portions of a tapering torso.

While several brassieres are provided in the prior art which have split or multi-band chest bands, they provide two thin straps with single connectors crossing in front of the brassieres as well as the back with no wide chest band, which do not provide strong support and lack the range of firm adjustability provided by the present invention.

U.S. Pat. No. 2,451,001, issued Oct. 12, 1948 to Speiser, claims a strapless brassiere including a body encircling portion comprising three straps: a first strap that runs under the breasts, a second strap above the breasts and a third strap extending over the breasts. Each strap has complementary fastening devices on the ends thereof.

U.S. Pat. No. 2,363,017, issued Nov. 21, 1944 to Plehn, describes a brassiere shoulder strap construction wherein the shoulder straps are formed from one continuous adjustable strap that runs over a first shoulder, through a first guide element and a first elastic member attached to a first end portion of the chest band, across the span between the two ends of the chest band, through a second elastic member attached to a second end portion of the chest band and a second guide element, and over the second shoulder. The spanning portion of the continuous strap forms a second strap crossing the user's back.

U.S. Pat. No. 2,255,720, issued Sep. 9, 1941 to Lewis, discloses a brassiere two tapering back extensions sew to the outer edge of each breast cup. On the outer side of each breast cup, the upper tapering back extension has a loop at the end thereof and the lower tapering back extension has a buttonhole at the end thereof. The shoulder straps are threaded though the accompanying upper tapering back extension and then crossed over each other and fastened by a button to the buttonhole at the end of the opposite lower tapering back extension.

Two U.S. Pat. Nos. 1,804,855 issued May 12, 1931 and 1,766,278 issued Jun. 24, 1930 to Bollwine, indicate a brassiere with two body encircling straps. The first lower strap is adjustable and runs beneath the breasts and around to the back. The second upper strap is formed from a tapered wing extension projecting from the outer edge of each breast cup and a connecting strap which is elastic and provides tension at a higher position to provide more lift for the breasts.

U.S. Pat. No. 1,782,044, issued Nov. 18, 1930 to Lustgarten, puts forth a bra which has two adjustable straps attached, one on each end, to the chest encircling band. The adjustable straps are each attached to one of the ends of the chest encircling band at the bottom edge and are fastened and worn in a crisscrossed fashion with the ends of the adjustable straps fastened to the opposing end of the chest encircling band at an upper edge.

U.S. Pat. No. 1,667,796, issued May 1, 1928 to Morrison, concerns a brassiere with an upper and a lower torso encircling band. The lower band runs underneath the breast cups. The upper band comprises a strap with ends that diverge into a plurality of connecting ends that are affixed to the side of a breast cup. Both bands are shown in FIG. 3 to have a closure at the back. The shoulder straps are connected in the back to both bands.

U.S. Patent Application #20080125011, published May 29, 2008 by Gleeson, claims an uplift bra with two breast cups, joined together at a mid region. A chest strap extends from each breast cup, to encompass the chest of the wearer. The chest straps are engaged to each breast cup at least two locations, a first location being above a second location. Each breast cup has a panel with a perimeter defining a neckline and a support line. The support line is of a continuously curved nature between its upper terminus where a shoulder support strap is located, and its inner terminus where the cups are joined. The breast cups each include a longitudinally extending line of inelasticity extending between the first location and the mid region.

U.S. Patent Application #20080113587, published May 15, 2008 by Richardson, describes a front hook bra and a truss for supporting breasts of a user wearing the bra. The bra has a first cup, a second cup and/or the truss for supporting and/or for enclosing the breasts of the user. The truss connects a rear end of the first portion to a rear end of the second portion and comprises three adjustable straps extending from an outer side of each cup. The ends of the six straps are joined in the center of the wearer's back by a ring. The truss reduces stress of, strain of and/or pain in shoulders, a neck and/or a back of the user from the weight of the breasts of the user. The bays, the truss and/or the cups of the bra minimize unwanted movements of the breast of the user.

U.S. Patent Application #20060189254, published Aug. 24, 2006 by Hood, discloses a strapless bra including an upper strap system coupled to an upper portion of each of first and second cup members, wherein the upper strap system includes first and second strap members selectively operable to couple to one another, and a lower strap system coupled to a lower portion of each of the first and second cup members, wherein the lower strap system includes third and fourth strap members selectively operable to couple to one another. The upper strap system is selectively operable to conform to a first girth and the lower strap system is selectively operable to conform to a second girth. The first and second girths can be unequal.

U.S. Pat. No. 2,579,546, issued Dec. 25, 1951 to Cadous, is for a strapless brassiere which has back panels attached to the sides of the cups. Each back panel has a top and a bottom tape with adjustable slides. The top tape and bottom tape may be adjusted independently to fit the user.

U.S. Pat. No. 2,468,622, issued Apr. 26, 1949 to Glick, provides a strapless brassiere which has two adjustable chest encircling straps which are attached to the breast cup at different elevations and which are worn and fastened in a criss-crossed fashion. Alternately, a fabric patch may be sewn to the upper and lower straps of each side of the chest band as shown in FIG. 6.

U.S. Pat. No. 2,454,154, issued Nov. 16, 1948 to Glick, shows a strapless brassiere which has two adjustable chest encircling straps which are attached to the breast cup at different elevations and which are worn and fastened in a criss-crossed fashion.

U.S. Pat. No. 1,197,344, issued Sep. 5, 1916 to Clark, illustrates a bust confining and reducing garment with an upper elastic strap and a lower back closure. The upper elastic strap is permanent and does not comprise a closure. The lower back closure comprises tapered extensions from the garment having straps attached to the ends thereof. The straps are drawn to the front of the user and tied to secure the lower back closure.

U.S. Pat. No. 1,067,289, issued Jul. 15, 1913 to Volk, is for a breast supporter which may be used with an abdominal support. The breast supporter comprises a pair of breast cups connected to each other by joining straps at their adjacent edges. Attached to the outer side edge of the first breast cup are an upper strap and a lower strap which encircle the body and are fastened on the outer side edge of the second breast cup.

U.S. Pat. No. 4,276,884, issued Jul. 7, 1981 to O'Daniels, provides a brassiere comprising two breast-receiving cups, a halter-type strap having its opposite ends connected to respective cups extending over the wearer's shoulders with a median section lying horizontally across the wearer's back and tensioned by two lateral straps connecting said halter-type strap to the back portion of the brassiere.

U.S. Pat. No. D475,835, issued Jun. 17, 2003 to Hoffman et al, shows the ornamental design for an adjustable bra.

What is needed is a single wide elasticized strap or chest band extending from each cup area of a bra having each chest band divided into at least two vertically spaced connecting fingers at the back with multiple vertically spaced pairs of connectors on each of the connecting fingers each having separate adjustability to allow the bra to attach firmly and comfortably around a tapered torso of a wearer taking into account the varying girth at different heights on the tapered body.

BRIEF SUMMARY OF THE INVENTION

An object of the present invention is to provide a single wide elasticized strap or chest band extending from each cup area of a bra having each chest band divided into at least two vertically spaced connecting fingers at the back with multiple vertically spaced pairs of connectors on each of the connecting fingers each having separate adjustability to allow the bra to attach firmly and comfortably around a tapered torso of a wearer taking into account the varying girth at different heights on the tapered body.

One more object of the present invention is to provide a secure multiple end strap on a single breast band on each side of a bra to create a torso contouring adjustable bra for sleeping with a center breast support, positioned between the breasts, which supports the breasts with the woman sleeping on her side to prevent the upper breast from tending to hang down toward the lower breast and thereby prevent wrinkles in the skin in the center of the upper chest.

In brief, multiple vertically spaced end strap connectors extend from the end of a single wide elasticized chest band extending laterally outward from each cup portion on a bra, each wide chest band being divided into multiple connector fingers at the end furthest from the cup creating at least two smaller vertically separated horizontal connector fingers having separate adjustable connectors on each mating pair of connecting fingers to allow separate adjustability of the mating horizontal connector fingers to fit securely around a tapered torso of a wearer.

Each of the pairs of mating connecting fingers are adjustably connected by using hooks with each hooked into one of multiple eyelets spaced along the finger, mating hook and loop fasteners, snap heads with each snapped into one of multiple spaced mating snap receivers, or other adjustable connectors.

A pocket may be fabricated in the bra between the cups for receiving a center breast support, positioned between the breasts, which supports the breasts with the woman sleeping on her side to prevent the upper breast from tending to hang down toward the lower breast and thereby prevent wrinkles in the skin in the center of the upper chest. The bra for sleeping is preferably fabricated of soft fabric and may have a zipper for accessing the pocket. The pocket is formed by stitching a sheet of material to the inside of the bra between the cups, thereby forming a barrier between the support pad and the skin of the woman.

An advantage of the present invention is that the connecting fingers each have separate adjustability to allow the bra to attach firmly and comfortably around a tapered torso of a wearer taking into account the varying girth at different heights on the tapered body.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
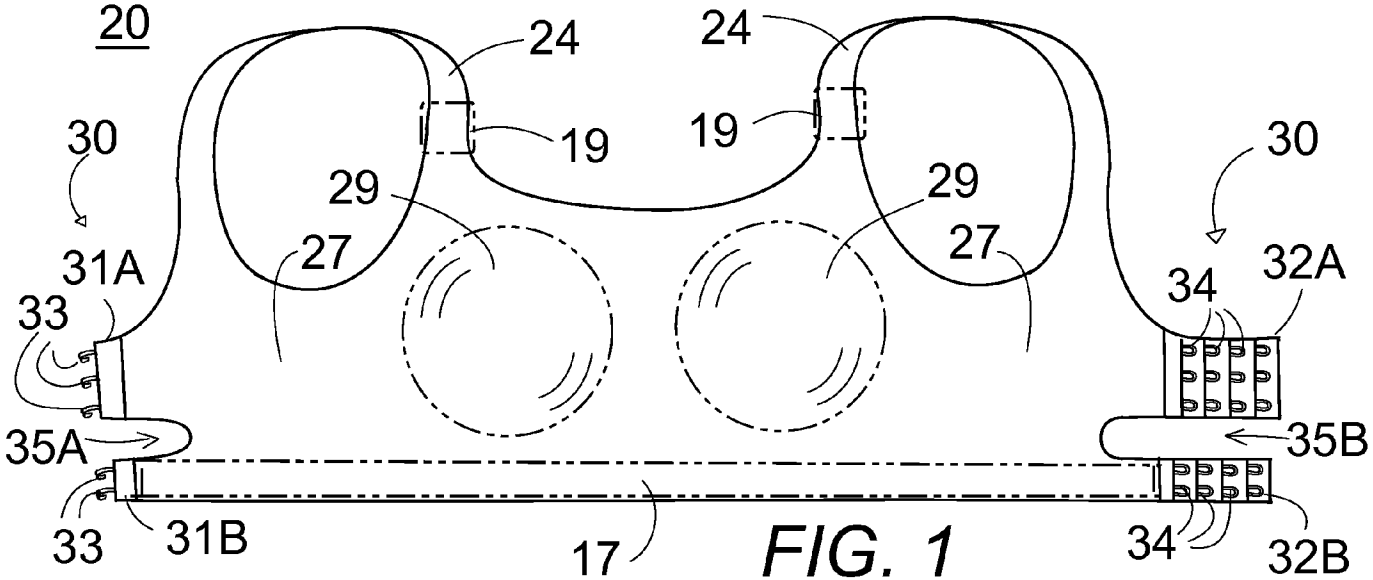
FIG. 1 is a front elevational view of a pair of individually adjustable connecting fingers extending from an outer end of each single chest band attached to each cup of the present invention shown on a bra having end hooks on set of spaced fingers and mating eyelets attached along the length of the mating spaced fingers for adjustable connectors between the fingers.

In FIGS. 1-5, an adjustable multiple end strap fastener device 30, 30A, 30B, and 30C for a bra extends from a single chest band 27 from each cup 29 of the bra 20. The single chest band 27 extends horizontally from an outer end of each of two cups 29 of the bra 20 so that the single chest bands 27 together providing full support for the two cups 29.

At least two spaced connecting fingers 31A, 31B, 32A and 32B extend horizontally from each outer end of each single chest band 27. Each of the connecting fingers on one chest band 31A and 31B align with one of the connecting fingers 32A and 32B on the other chest band to form spaced pairs of connecting fingers.

Each of the pairs of connecting fingers is independently interconnected adjustably (finger 31A to finger 32A and finger 31B to finger 32B) so that each of the pairs of connecting fingers is secured together to a desired degree of tightness around a torso of a wearer according to the size of the torso at the location of each of the pairs of connecting fingers. The bra attaching device 30 adjusts to the torso of the wearer to provide full support for the wearer, thereby forming an adjustable multiple end strap fastener device for a bra extending from a single chest band 27 from each cup 29 of the bra 20.

In FIG. 1, the means for adjustably interconnecting each of the pairs of connecting fingers 31A to 32A and fingers 31B to 32B comprises mating hook 33 and eye closures 34. The mating hook and eye closures comprise two vertically spaced rigid hooks 33 attached to an outer edge of a bottom finger 31B on a first single chest band 27 and two vertically spaced rows of horizontally spaced mating rigid eyes 34 to form spaced columns of rigid eyes along the length of the bottom finger 32B on the second single chest band 27 for receiving the rigid hooks 33 adjustably connected to desired rigid eyes 34 to adjust to the size of the torso of the wearer under each of the fingers separately. The mating hook and eye closures comprise three vertically spaced rigid hooks 33 attached to an outer edge of a wider top finger 31A on a first single chest band 27 and three vertically spaced rows of horizontally spaced mating rigid eyes 34 to form spaced columns of rigid eyes along the length of the wider top finger 32A on the second single chest band 27 for receiving the rigid hooks 33 adjustably connected to desired rigid eyes 34 to adjust to the size of the torso of the wearer under each of the fingers separately. The top wider fingers 31A and 32A provide more support around the torso at the location of the cups 29 supporting the breasts. The bottom narrower fingers 31B and 32B require less support and can be adjusted separately to conform to a different girth of the torso at the bottom of the bra below the location of the cups 29 supporting the breasts.

Figure 1B:
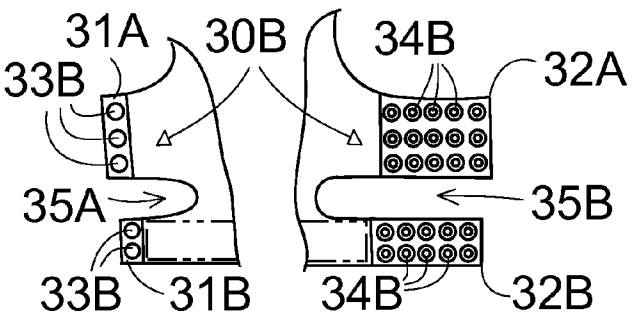
FIG. 1B is a partial front elevational view of the pair of individually adjustable connecting fingers extending from an outer end of each single chest band attached to each cup of on the bra of FIG. 1 having mating snap fasteners for adjustable connectors between the fingers.
Figure 1A:
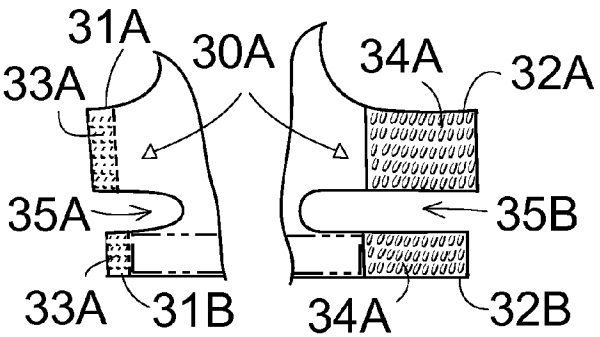
FIG. 1A is a partial front elevational view of a pair of individually adjustable connecting fingers extending from an outer end of each single chest band attached to each cup of on the bra of FIG. 1 having mating hook and loop fasteners for adjustable connectors between the fingers.
Figure 2:
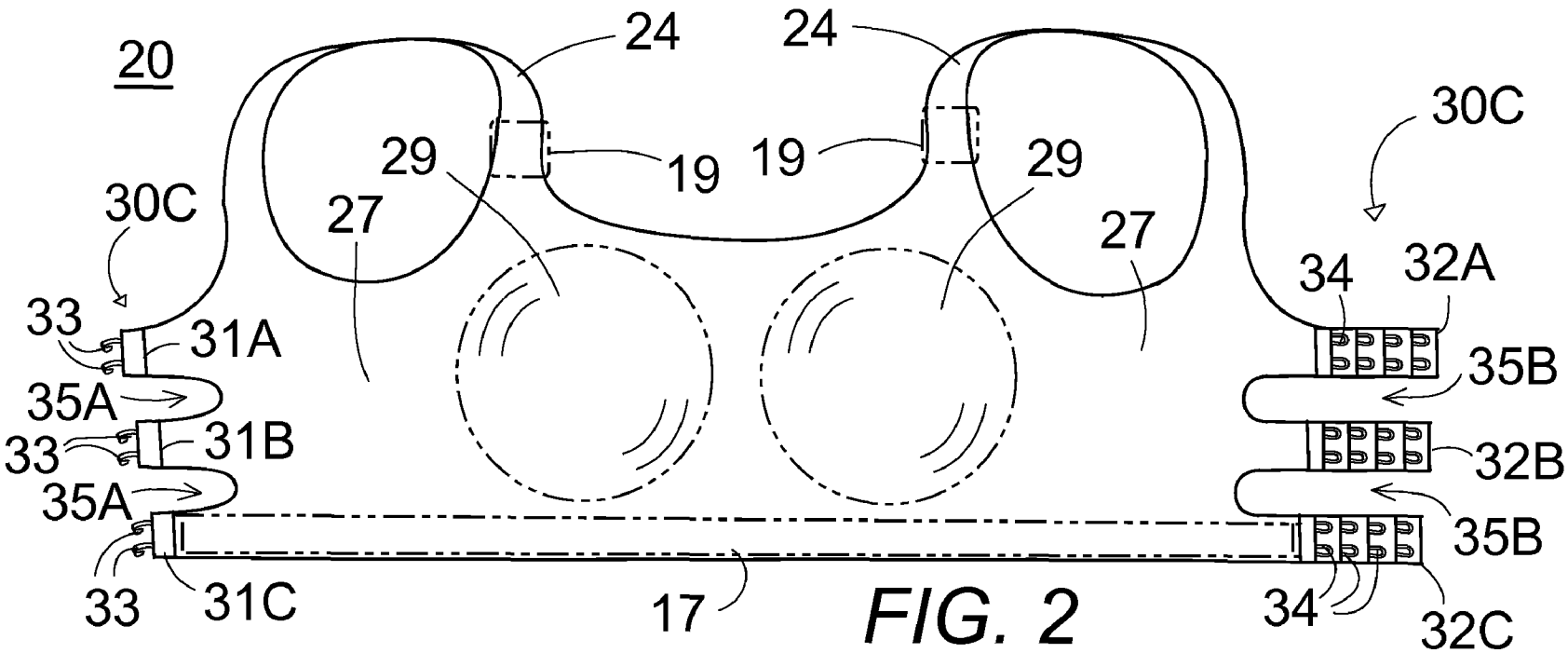
FIG. 2 is a front elevational view of three individually adjustable connecting fingers extending from an outer end of each single chest band attached to each cup of the present invention shown on a bra having end hooks on set of spaced fingers and mating eyelets attached along the length of the mating spaced fingers for adjustable connectors between the fingers.
Figure 3:
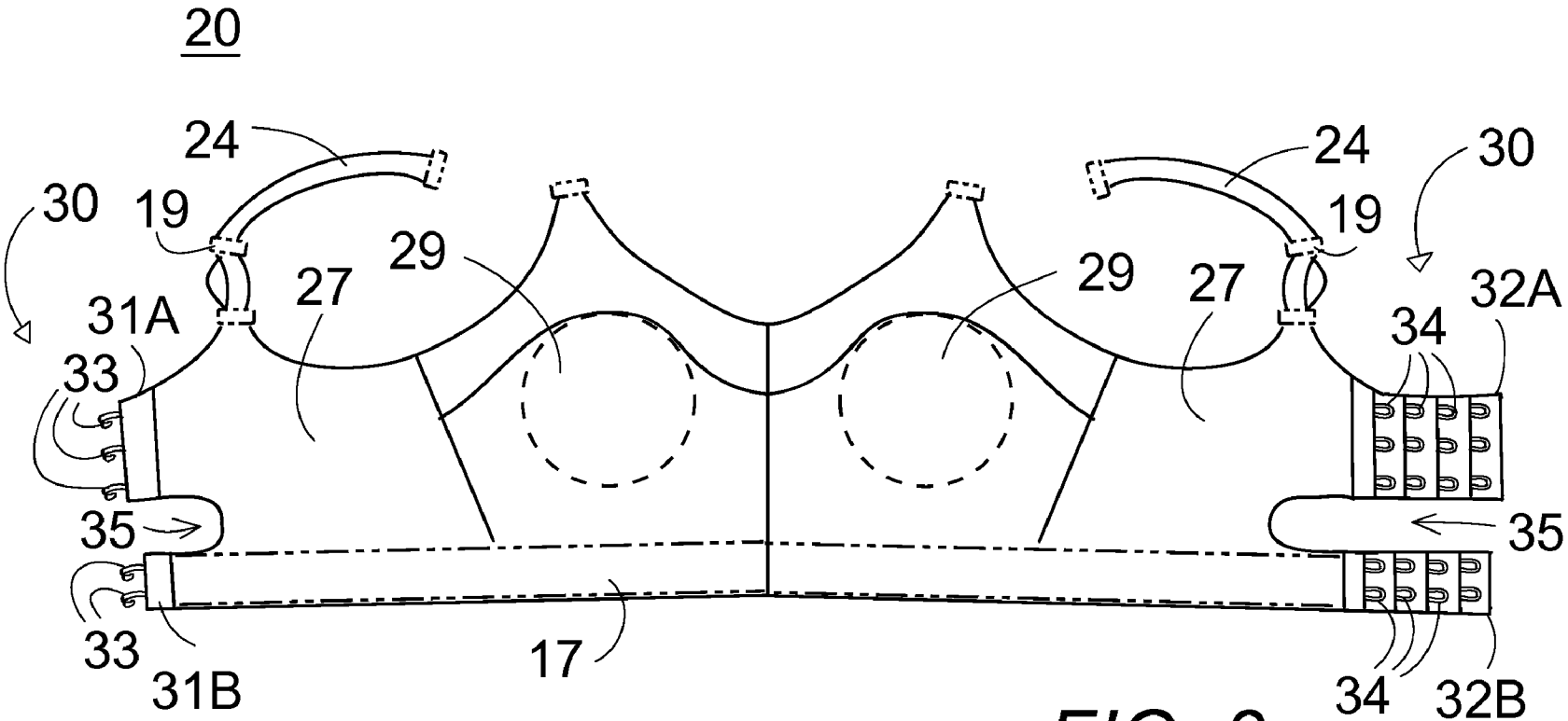
FIG. 3 is a front elevational view of a pair of individually adjustable connecting fingers extending from an outer end of each single chest band attached to each cup of the present invention shown on an alternately structured bra having end hooks on set of spaced fingers and mating eyelets attached along the length of the mating spaced fingers for adjustable connectors between the fingers.

In FIG. 1A, the means for adjustably interconnecting each of the pairs of connecting fingers 31A to 32A and 31B to 32B comprises mating hook 33A and loop 34A fasteners. The mating hook 33A and loop 34A fasteners comprise a strip of a first component of a hook and loop fastener, which is shown as a hook fastener 33A attached to a portion of the inner face adjacent to an outer edge of each of the fingers 31A and 31B on a first single chest band and a mating second component of the hook and loop fastener, shown as a mating loop fastener 34A attached to the outer face along the length of the mating fingers 32A and 32B of a second chest band along a substantial portion of the length of the fingers for connecting the hook fasteners 33A to any desired portion of the mating loop fasteners 34A on the mating fingers of the second single chest band to adjust to the size of the torso of the wearer under each of the mating fingers separately.

In FIG. 1B, the means for adjustably interconnecting each of the pairs of connecting fingers comprises mating snap fasteners 33B and 34B. The mating snap fasteners comprise at least two vertically spaced first snap fastener components 33B attached to each of the fingers 31A and 31B on a first single chest band and at least two vertically spaced rows of horizontally spaced mating second snap fastener components 34B forming a series of spaced columns of the second snap fastener components along the length of the mating fingers 32A and 32B of a second chest band for connecting the first snap fastener components to any of the mating columns of second fastener components to adjust to the size of the torso of the wearer under each of the fingers separately.

The chest bands 27 preferably each comprise a strip of elasticized material extending from one of the two cups 29.

An optional elasticized strip 17 may extend along a bottom edge of the bra below the cups 29 for added support.

Vertical shoulder straps 24 with adjusting means 19 such as adjusting buckles may provide additional support.

Figure 4B:
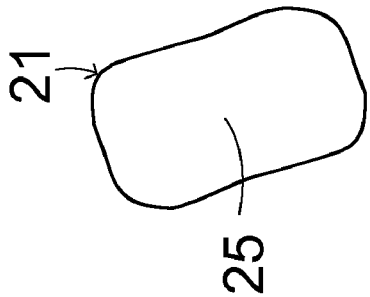
FIG. 4B is a plan view of the padded breast support pad of FIG. 4 showing the outer somewhat flat portion that contacts the front of the bra.
Figure 4A:
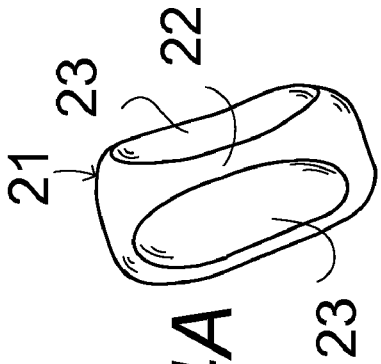
FIG. 4A is a perspective view of the padded breast support pad of FIG. 4 showing the bottom inwardly curved sections for supporting the breasts and the ridge between the curved sections which contacts the back of the pocket of the bra adjacent to a chest area of the wearer between the breasts.
Figure 4:
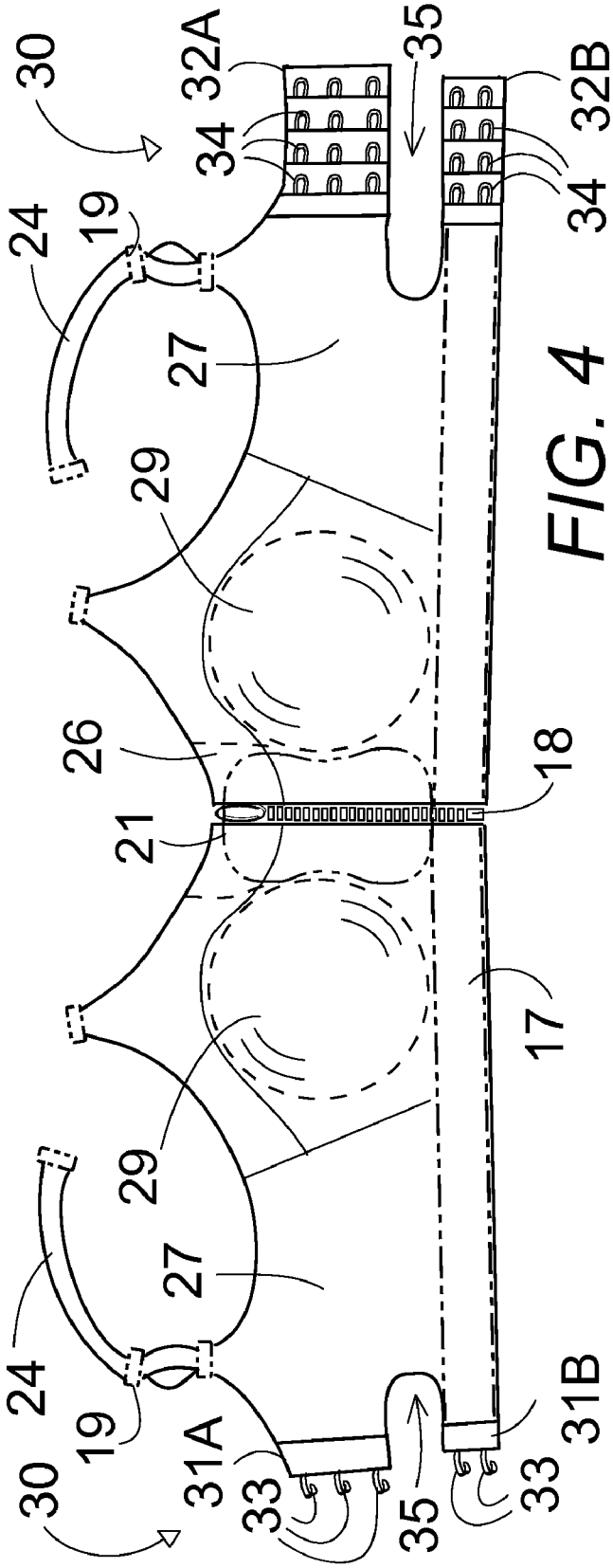
FIG. 4 is a front elevational view of a pair of individually adjustable connecting fingers extending from an outer end of each single chest band attached to each cup of the present invention shown on an alternately structured bra having end hooks on set of spaced fingers and mating eyelets attached along the length of the mating spaced fingers for adjustable connectors between the fingers and showing a central pocket with a zipper between the cups holding a padded breast support pad for use in sleeping.

In FIGS. 4, 4A and 4B, a breast support pad 21 may be inserted within the bra 20 between the cups 29 supporting the breasts of a user. The breast support pad 21 may comprises a firm body that has a somewhat flat or flat front face 25, as shown in FIG. 4B and a concave curved cavity 23 on each side of a centrally located smooth vertical surface 22, which vertical surface conforms to the chest structure between the breasts of a user. Each concave curved cavity 23 conforms to a breast of a user with the breast support pad positioned against the chest of the user between the breasts of the user, so that when the user of the breast support pad is lying on one side and one breast is in an upper position and the other breast lies thereunder in a lower position, the breast pad supports the upper breast of the user with the upper breast supported by an upper concave curved cavity to prevent the upper breast from drooping down over the lower breast to prevent wrinkling of the skin on the chest of the user in the chest area between the breasts of the user.

Figure 5:
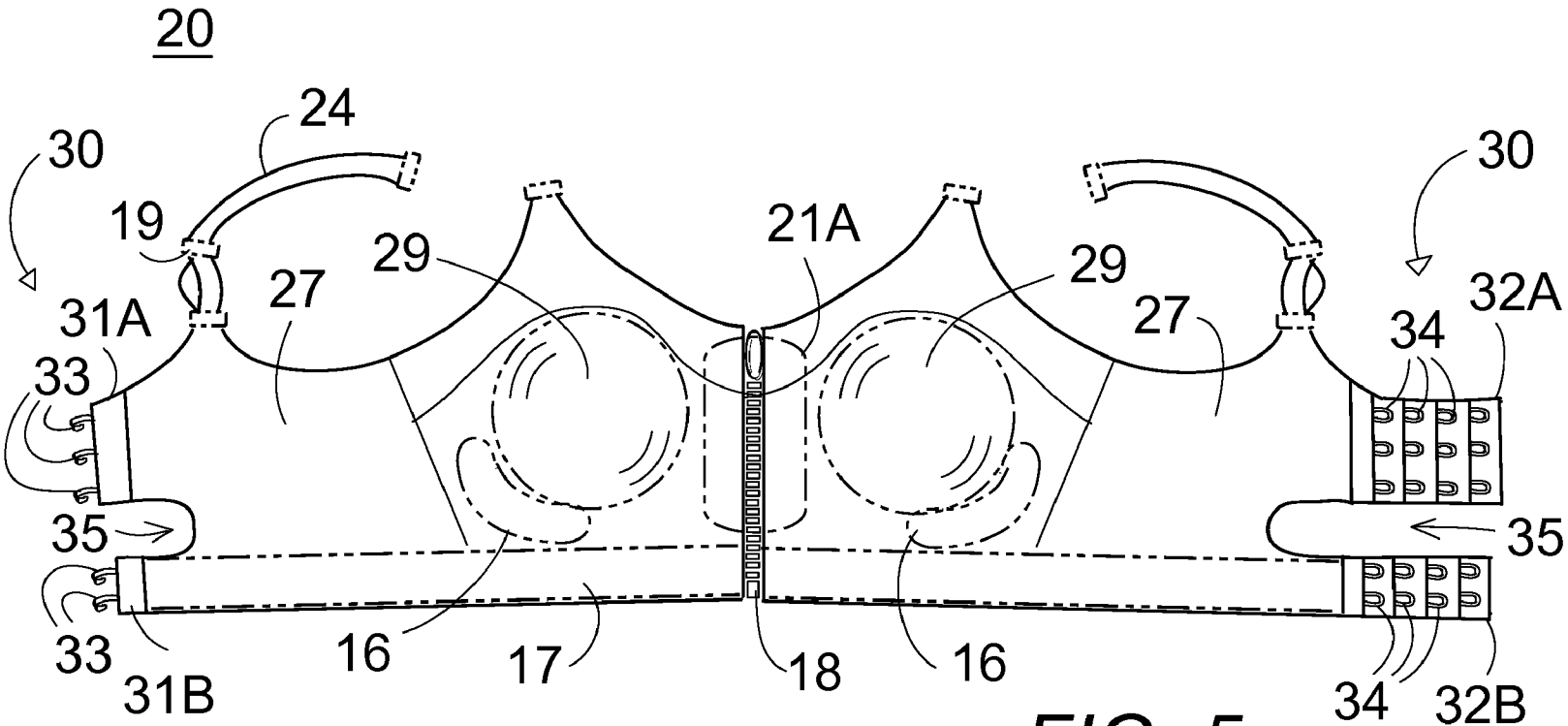
FIG. 5 is a front elevational view of a pair of individually adjustable connecting fingers extending from an outer end of each single chest band attached to each cup of the present invention shown on an alternately structured bra having end hooks on set of spaced fingers and mating eyelets attached along the length of the mating spaced fingers for adjustable connectors between the fingers and showing a central pocket with a zipper between the cups holding a gel pack breast support pad between the breasts and an area on the bottom and outer side of each breast cup to receive curved gel packs for breast support for use in medical bras and sleeping bras.

The breast support pad 21 may be formed of a soft dense foam material, a soft molded material, or a gel pack 21A, shown in FIG. 5. A removable soft absorbent fabric casing may be used for housing the breast support pad. In FIGS. 4 and 5, a pocket 26 may be attached to an inside of a central portion of the bra to secure the breast support pad in place. A zipper 18 may be located at a center front portion of the bra for accessing the pocket 26 or the pocket 26 may have an open top. The breast support pad 21 may be secured to the inside of the bra by using mating hook and loop fasteners or two sided adhesive strips.

In FIG. 5, additional gel packs 16 may be inserted within the bra below the breasts for additional support, useful in the medical field as well as for sleeping.

In use, the bra of the present invention is secured around the user by adjusting each of the mating pairs of connecting fingers individually to secure the bra around the tapered torso of the user. Each of the pairs of mating fingers is adjusted independently to allow the bra to attach firmly and comfortably around a tapered torso of a wearer taking into account the varying girth at different heights on the tapered body of the wearer.

The individually adjustable mating connecting fingers of the present invention are particularly useful for women having large breasts, medical conditions, and engaging in athletic activity.

The center breast support pad 21 and 21A may be tucked inside the brassiere in the part of the brassiere that is the section located between the two breast cups. Thus, in one embodiment, no securement means for the center breast support pad is required because the section of the brassiere between the two breast cups is adequate by itself to support the center breast support pad and keep it in place between the breasts while the user sleeps on her side while wearing the bra. Examples of uses where a separate securement means is not required for the center breast support pad are the so-called comfort bras and exercise bras which typically have wide sections of strong, stretchable fabric between the two breast cups for added support.

It is understood that the preceding description is given merely by way of illustration and not in limitation of the invention and that various modifications may be made thereto without departing from the spirit of the invention as claimed.

What is claimed is:

1. A bra comprising:

left and right cups, said left and right cups being concave and sized to hold the breasts of the bra wearer;

a chest band supporting and connecting said left and right cups;

a left strap extending laterally and rearwardly from said left cup, said left strap having at least two laterally extending left side fingers including upper and lower left side fingers, said upper and lower left side fingers being spaced apart from one another and said left strap end terminating at said upper and lower left side finger's distal ends;

a first set fasteners located on the distal ends of said left side fingers;

a right strap extending laterally and rearwardly from said right cup, said right strap having at least two laterally extending right side fingers including upper and lower right side fingers, said upper and lower right side fingers being spaced apart from one another and said right strap end terminating at said upper and lower right side finger's distal ends;

a second set of fasteners located on the distal end of said right side fingers, said second set of fasteners constructed to overlap and affix to said first set of fasteners;

said bra constructed to be worn by a human such that said left and right cups are positioned for receiving human breasts and said left and right straps extend rearwardly of a human torso so that said first and second sets of fasteners overlap and affix adjacent to a human back;

and said upper and lower fingers spaced apart and said first and second fasteners constructed to affix to one another while permitting adjustment of the overlap of said upper fingers relative to the overlap of said lower fingers so that said bra at said upper fingers may be adjusted tighter or looser around a human torso relative to said lower fingers.

2. The bra of claim 1 wherein said first and second sets of fasteners comprise hook and eye loops including at least two hooks located at the distal end of said left or right side fingers and at least two sets of eye loops located at the alternative distal end of said left or right side fingers to where the at least two hooks are located wherein each set of eye loops includes at least two horizontally spaced eye loops to allow lateral adjustment of said upper fingers relative to said lower fingers.

3. The bra of claim 1 wherein said first and second sets of fasteners comprise hook and pile fasteners.

4. The bra of claim 1 wherein said first and second sets of fasteners comprise snap fasteners.

5. The bra of claim 1 further comprising left and right shoulder straps, said left shoulder strap extending from said left cup to said left strap, said right shoulder strap extending from said right cup to said right strap.

6. The bra of claim 1 wherein said chest band is not adjustable.

7. A bra comprising:

left and right cups, said left and right cups being concave and sized to hold the breasts of the bra wearer;

a chest band supporting and connecting said left and right cups wherein said chest band is not adjustable;

a left strap extending laterally and rearwardly from said left cup, said left strap having at least two laterally extending left side fingers including upper and lower left side fingers, said upper and lower left side fingers being spaced apart from one another and said left strap end terminating at said upper and lower left side finger's distal ends;

a first set fasteners located on the distal ends of said left side fingers;

a right strap extending laterally and rearwardly from said right cup, said right strap having at least two laterally extending right side fingers including upper and lower right side fingers, said upper and lower right side fingers being spaced apart from one another and said right strap end terminating at said upper and lower right side finger's distal ends;

a second set of fasteners located on the distal end of said right side fingers, said second set of fasteners constructed to overlap and affix to said first set of fasteners;

left and right shoulder straps, said left shoulder strap extending from said left cup to said left strap, said right shoulder strap extending from said right cup to said right strap said bra constructed to be worn by a human such that said left and right cups are positioned for receiving human breasts and said left and right straps extend rearwardly of a human torso so that said first and second sets of fasteners overlap and affix adjacent to a human back;

said first and second sets of fasteners comprise hook and eye loops including at least two hooks located at the distal end of said left or right side fingers and at least two sets of eye loops located at the alternative distal end of said left or right side fingers to where the at least two hooks are located, each set of eye loops includes at least two horizontally spaced eye loops to allow adjustment of said upper fingers relative to said lower fingers, and said upper and lower fingers spaced apart to permit said first and second fasteners to affix to one another while still permitting adjustment of the overlap of said upper fingers relative to the overlap of said lower fingers so that said bra at said upper fingers may be adjusted tighter or looser around a human torso relative to said lower fingers.

* * * * *